US011651946B2

(12) United States Patent
Sakagoshi

(10) Patent No.: US 11,651,946 B2
(45) Date of Patent: May 16, 2023

(54) MASS SPECTROMETER

(71) Applicant: SHIMADZU CORPORATION, Kyoto (JP)

(72) Inventor: Yusuke Sakagoshi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/345,080

(22) Filed: Jun. 11, 2021

(65) Prior Publication Data

US 2022/0084807 A1 Mar. 17, 2022

(30) Foreign Application Priority Data

Sep. 15, 2020 (JP) ..... JP2020-154315

(51) Int. Cl.
*H01J 49/24* (2006.01)
*H01J 49/42* (2006.01)

(52) U.S. Cl.
CPC ..... *H01J 49/24* (2013.01); *H01J 49/4225* (2013.01)

(58) Field of Classification Search
CPC .... H01J 49/24; H01J 49/0422; H01J 49/0481; F04D 19/04; F04D 19/042; F04D 19/044; F04D 19/046
See application file for complete search history.

(56) References Cited

U.S. PATENT DOCUMENTS 9,368,335 B1 6/2016 Quarmby et al.
2015/0056060 A1* 2/2015 Makarov ..... H01J 49/24 415/66

* cited by examiner

*Primary Examiner* — David E Smith
*Assistant Examiner* — Hsien C Tsai
(74) *Attorney, Agent, or Firm* — Sughrue Mion, PLLC

(57) ABSTRACT

A mass spectrometer includes a vacuum chamber, a turbomolecular pump, and a roughing pump. The vacuum chamber is divided into a low vacuum chamber and a high vacuum chamber respectively provided with, on their wall surfaces, a first opening and a second opening. The turbomolecular pump has an operation chamber including in its inside a blade rotor and being provided with a first intake port, and an exhaust chamber communicating with the operation chamber and being provided with a second intake port and an exhaust port. The turbomolecular pump is placed so that the high vacuum chamber and the operation chamber communicate with each other through the second opening and the first intake port, and the low vacuum chamber and the exhaust chamber communicate with each other through the first opening and the second intake port. The roughing pump is connected to the exhaust port.

3 Claims, 1 Drawing Sheet

MASS SPECTROMETER

TECHNICAL FIELD

The present invention relates to a mass spectrometer.

BACKGROUND ART

A mass spectrometer has been widely used for detecting target components contained in a sample and for determining the quantities of the target components. The mass spectrometer includes: an ionization unit; an ion transport optical system for transporting ions generated in the ionization unit to a later stage; a mass-separating unit for performing mass separation of ions; and an ion-detecting unit for detecting ions that have undergone mass separation. As the ionization unit, an electrospray ionization (ESI) source in which ions are generated from a liquid sample at approximately atmospheric pressure may be used. The ion transport optical system, the mass-separating unit, and the ion-detecting unit are housed in a vacuum chamber.

The vacuum chamber is divided into a low vacuum chamber in which the ion transport optical system is placed and a high vacuum chamber (analysis chamber) in which the mass-separating unit and the ion-detecting unit are placed. The low vacuum chamber is evacuated to a pressure of $10^{-1}$ to $10^{-2}$ Pa by a roughing pump, such as a rotary pump or a diaphragm pump. The high vacuum chamber is evacuated to a pressure of $10^{-3}$ Pa or lower, which is lower than the pressure in the low vacuum chamber (i.e., the degree of vacuum in the high vacuum chamber is higher than that in the low vacuum chamber), by a turbomolecular pump. The turbomolecular pump includes an operation chamber provided with an intake port, and an exhaust chamber communicating with the operation chamber and provided with an exhaust port. The exhaust chamber is connected to the roughing pump. A rotor having blades (blade rotor) is provided inside the operation chamber, and is rotated at high speed to displace gas entering from the intake port to the exhaust chamber. The gas displaced to the exhaust chamber is discharged from the exhaust port by the roughing pump.

The roughing pump for evacuating the low vacuum chamber, the turbomolecular pump for evacuating the high vacuum chamber, and another roughing pump used together with the turbomolecular pump may be individually provided. In such configuration, it is necessary to prepare three vacuum pumps in total. Patent Literature 1 discloses a mass spectrometer available with a cost reduction by reducing the number of vacuum pumps to be used.

The mass spectrometer disclosed in Patent Literature 1 has a vacuum chamber, the inside of which is divided into a low vacuum chamber and a high vacuum chamber in an axial direction (the central axis of the flight path of ions). A first opening and a second opening are provided in a wall of the low vacuum chamber, and a third opening is provided in a wall of the high vacuum chamber. The first and third openings are provided at the same circumferential position in the outer periphery of the vacuum chamber. The turbomolecular pump is placed adjacent to the vacuum chamber so that the intake port of the turbomolecular pump is attached to the third opening and the exhaust port of the turbomolecular pump is attached to the first opening. The second opening of the vacuum chamber is connected to a foreline pump (roughing pump). In this mass spectrometer, the high vacuum chamber is evacuated through the third opening of the vacuum chamber and the intake port of the turbomolecular pump. Gas displaced from the operation chamber to the exhaust chamber in the turbomolecular pump is discharged by the foreline pump via the low vacuum chamber. In other words, in this mass spectrometer, the roughing pump for evacuating the low vacuum chamber also functions as a roughing pump for discharging the gas exhausted from the turbomolecular pump.

CITATION LIST

Patent Literature

Patent Literature 1: U.S. Pat. No. 9,368,335 B

SUMMARY OF INVENTION

Technical Problem

A low vacuum chamber may include in its interior an ion transport optical system, which transports ions generated in an ionization unit to a later stage, for example. In such a case, a voltage supplier is provided for applying predetermined voltages to the electrodes that constitute the ion transport optical system. In the mass spectrometer disclosed in Patent Literature 1, the turbomolecular pump is connected to the first and third openings of the vacuum chamber, and the foreline pump is connected to the second opening, as described earlier. Thus, in a case where the turbomolecular pump is provided in one side of the outer periphery of the vacuum chamber and the foreline pump is connected to the vacuum chamber in another side of its outer periphery, spaces in the two sides of the outer periphery of the vacuum chamber are occupied. This occupation restricts the spaces for placing the voltage supplier and structural components other than vacuum components. In addition, it is difficult to miniaturize the mass spectrometer.

An objective to be achieved by the present invention is to facilitate the placement of structural components other than vacuum components around the vacuum chamber of the mass spectrometer, and to enable the entire mass spectrometer to be miniaturized.

Solution to Problem

The present invention developed for solving the previously described problem is a mass spectrometer including:

a vacuum chamber divided into a low vacuum chamber and a high vacuum chamber, the low vacuum chamber having a wall provided with a first opening, and the high vacuum chamber having a wall provided with a second opening;

a turbomolecular pump having: an operation chamber that includes, in its interior, a blade rotor and is provided with a first intake port; and an exhaust chamber that communicates with the operation chamber and is provided with a second intake port and an exhaust port, the turbomolecular pump being placed so that the high vacuum chamber and the operation chamber communicate with each other through the second opening and the first intake port, and the low vacuum chamber and the exhaust chamber communicate with each other through the first opening and the second intake port; and a roughing pump connected to the exhaust port.

Advantageous Effects of Invention

In the mass spectrometer according to the present invention, the blade rotor provided in the operation chamber of the turbomolecular pump is operated to evacuate the high vacuum chamber in which the mass-separating unit and others are placed, through the second opening and the first intake port. Gas displaced from the operation chamber to the exhaust chamber is discharged by the roughing pump connected to the exhaust port of the exhaust chamber. The low vacuum chamber is evacuated by the roughing pump through the first opening and the second intake port. In the mass spectrometer according to the present invention, the vacuum pump directly connected to the vacuum chamber is the turbomolecular pump only. Accordingly, structural components other than vacuum components can be easily provided around the vacuum chamber, in comparison with those in conventional mass spectrometers in which both the turbomolecular pump and the roughing pump are connected to the vacuum chamber. Furthermore, evacuation systems are put together in one side of the periphery of the vacuum chamber, so that the size of the entire apparatus can be reduced.

DESCRIPTION OF EMBODIMENTS

The respective first and second embodiments of the mass spectrometer according to the present invention are described as follows, with reference to the drawings.

First Embodiment

Figure 1:
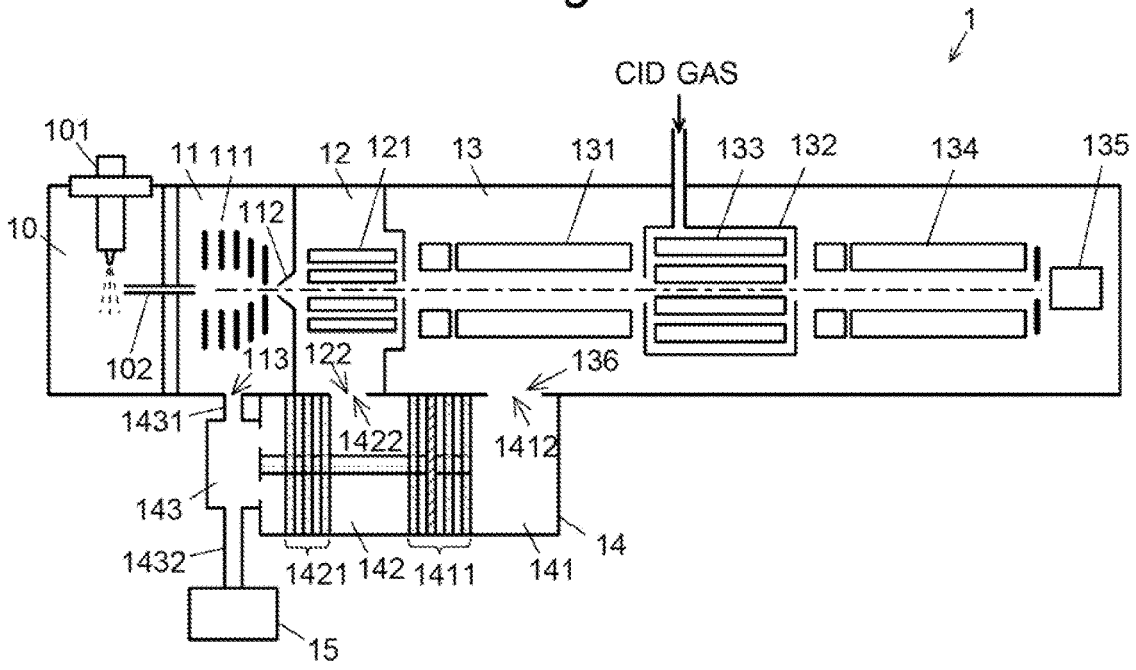
FIG. 1 is a block diagram showing main parts of a triple quadrupole mass spectrometer corresponding to the first embodiment of a mass spectrometer according to the present invention.

A mass spectrometer 1 according to the first embodiment is a triple quadrupole mass spectrometer. FIG. 1 shows the configuration of the main parts of the mass spectrometer 1 according to the first embodiment. The mass spectrometer 1 includes an ionization chamber 10, a first intermediate vacuum chamber 11, a second intermediate vacuum chamber 12, and an analysis chamber 13. These chambers are provided in a vacuum chamber. The ionization chamber 10 is set at approximately atmospheric pressure. The mass spectrometer 1 has a multi-stage differential pumping system in which the degree of vacuum gradually increases in the order of the first intermediate vacuum chamber 11, the second intermediate vacuum chamber 12, and the analysis chamber 13. An evacuation system will be described later.

The ionization chamber 10 includes an electrospray ionization probe (ESI probe) 101 that supplies an electric charge to a sample solution and sprays the charged sample solution. The ionization chamber 10 and the first intermediate vacuum chamber 11 communicate with each other through a heated capillary 102 having a small diameter.

The first intermediate vacuum chamber 11 includes an ion lens 111 composed of a plurality of annular-shaped electrodes for transporting ions to a later stage while converging them. The first intermediate vacuum chamber 11 and the second intermediate vacuum chamber 12 are separated by a skimmer 112 having a small hole at its apex.

The second intermediate vacuum chamber 12 includes an ion guide 121 composed of a plurality of rod-shaped electrodes for transporting ions to a later stage while converging them. The intermediate vacuum chamber 12 and the analysis chamber 13 communicate with each other through a small hole provided in a partition wall.

The analysis chamber 13 includes a front quadrupole mass filter (Q1) 131, a collision cell 132, a rear quadrupole mass filter (Q3) 134, and an ion-detecting unit 135. The front quadrupole mass filter 131 is composed of a pre-rod electrode and a main rod electrode. The collision cell 132 is provided with, in its interior, a multi-pole ion guide (q2) 133. The collision cell 132 is further provided with a gas introduction port for introducing collision-induced dissociation gas (CID gas), such as argon gas or nitrogen gas. The rear quadrupole mass filter 134 is composed of a pre-rod electrode and a main rod electrode.

The mass spectrometer 1 according to the first embodiment can perform a mass spectrometry (MS) scanning measurement, selected ion monitoring (SIM) measurement, MS/MS scanning measurement (product ion scanning measurement), multiple reaction monitoring (MRM) measurement, and so on. In the SIM measurement, ions do not undergo the selection in the front quadrupole mass filter 131 (the front quadrupole mass filter is not operated as a mass filter), but the mass-to-charge ratios of ions passing through the rear quadrupole mass filter 134 are fixed to detect ions.

In the MS/MS scanning measurement and MRM measurement, both the front quadrupole mass filter 131 and the rear quadrupole mass filter 134 are operated as the mass filter. The front quadrupole mass filter 131 allows ions having the mass-to-charge ratios set as those for precursor ions to pass through. CID gas is supplied to the collision cell 132 to cause fragmentation of the precursor ions, so that product ions are generated. In the MS/MS scanning measurement, the product ions are detected while the mass-to-charge ratios of ions passing through the rear quadrupole mass filter 134 are scanned. In the MRM measurement, the mass-to-charge ratios of ions passing through the rear quadrupole mass filter 134 are fixed to detect the product ions.

The first intermediate vacuum chamber 11, the second intermediate vacuum chamber 12, and the analysis chamber 13 are provided in the vacuum chamber. An evacuation system is provided adjacent to the vacuum chamber. The first intermediate vacuum chamber 11 is provided with an opening 113 (corresponding to a first opening of the present invention). The second intermediate vacuum chamber 12 is provided with an opening 122 (corresponding to a third opening of the present invention). The analysis chamber 13 is provided with an opening 136 (corresponding to a second opening of the present invention).

The evacuation system in the mass spectrometer 1 according to the first embodiment includes a turbomolecular pump 14 and a rotary pump 15. The turbomolecular pump 14 includes an operation chamber and an exhaust chamber 143. The inside of the operation chamber is divided into a first operation chamber 141 and a second operation chamber 142. A first blade rotor 1411 is placed between the first operation chamber 141 and the second operation chamber 142. A second blade rotor 1421 is placed in the second operation chamber 142 in the side close to the exhaust chamber 143. The first operation chamber 141 is provided with an intake port 1412 (corresponding to a first intake port of the present invention). The second operation chamber 142 is provided with an intake port 1422 (corresponding to a third intake port of the present invention). The exhaust chamber 143 is provided with an intake port 1431 (corresponding to a second intake port of the present invention) and an exhaust port 1432 that connects to the rotary pump 15.

The analysis chamber 13 communicates with the first operation chamber 141 through the opening 136 and the intake port 1412. The second intermediate vacuum chamber 12 communicates with the second operation chamber 142 through the opening 122 and the intake port 1422. The first intermediate vacuum chamber 11 communicates with the exhaust chamber 143 through the opening 113 and the intake port 1431.

Gas molecules taken from the intake port 1412 are displaced to the second operation chamber 142 by the first blade rotor 1411. Gas molecules taken from the intake port 1422 and gas molecules displaced by the first blade rotor 1411 are displaced to the exhaust chamber 143 by the second blade rotor 1421. The gas molecules displaced to the exhaust chamber 143 are discharged by the rotary pump 15.

In the evacuation system, the rotary pump 15 is first operated and the turbomolecular pump 14 is subsequently operated. These pumps are thus operated to evacuate the exhaust chamber 143 and the first intermediate vacuum chamber 11 to the pressure of $10^{-1}$ to $10^{-2}$ Pa. The second intermediate vacuum chamber 12 is evacuated to the pressure of $10^{-2}$ to $10^{-3}$ Pa. The analysis chamber 13 is evacuated to the pressure of $10^{-3}$ to $10^{-4}$ Pa. Accordingly, a differential pumping system is constituted, in which the degree of vacuum increases in the order of the first intermediate vacuum chamber 11, the second intermediate vacuum chamber 12, and the analysis chamber 13.

In the mass spectrometer 1 according to the first embodiment, only the single turbomolecular pump 14 and the single rotary pump 15 are used to constitute the differential pumping system, as described earlier. Conventional mass spectrometers have included, for example, a rotary pump for exhausting the first intermediate vacuum chamber 11, a turbomolecular pump for exhausting the second intermediate vacuum chamber 12, another rotary pump for discharging gas molecules displaced from the turbomolecular pump, another turbomolecular pump for exhausting the analysis chamber, and still another rotary pump for discharging gas molecules displaced from the other turbomolecular pump exhausting the analysis chamber, individually. In such conventional mass spectrometers, five total vacuum pumps have been required.

In contrast, in the mass spectrometer 1 according to the first embodiment, the turbomolecular pump has two rotary blades, and two intake ports 1412 and 1422 that are different in the exhaust flow rate. With this configuration, the second intermediate vacuum chamber 12 and the analysis chamber 13 can be differentially exhausted by only the single turbomolecular pump. In addition, the rotary pump 15 for evacuating the first intermediate vacuum chamber 11 is also used as the roughing pump for discharging the gas molecules displaced from the turbomolecular pump 14. Accordingly, it is only required for this configuration to include a single rotary pump.

In the mass spectrometer 1 according to the first embodiment, the opening 113 of the first intermediate vacuum chamber 11, the opening 122 of the second intermediate vacuum chamber 12, and the opening 136 of the analysis chamber 13 are placed in the same side of the vacuum chamber, and only the turbomolecular pump 14 is placed adjacent to the vacuum chamber. The first intermediate vacuum chamber 11 of the vacuum chamber and the rotary pump 15 are connected through the exhaust chamber 143 of the turbomolecular pump 14. In the mass spectrometer 1 according to the first embodiment, only the turbomolecular pump 14 is directly connected to the vacuum chamber as a vacuum pump. Accordingly, in the mass spectrometer 1, structural components other than vacuum components can be more easily provided around the vacuum chamber than those in conventional configurations, as disclosed in Patent Literature 1, in which the turbomolecular pump is placed in one side of the outer periphery of the vacuum chamber and the rotary pump is connected in another side. Furthermore, it is not necessary to place the rotary pump 15 in a position adjacent to the vacuum chamber. Therefore, the rotary pump 15 is placed in an appropriate position, so that the entire mass spectrometer 1 can be miniaturized.

Second Embodiment

Figure 2:
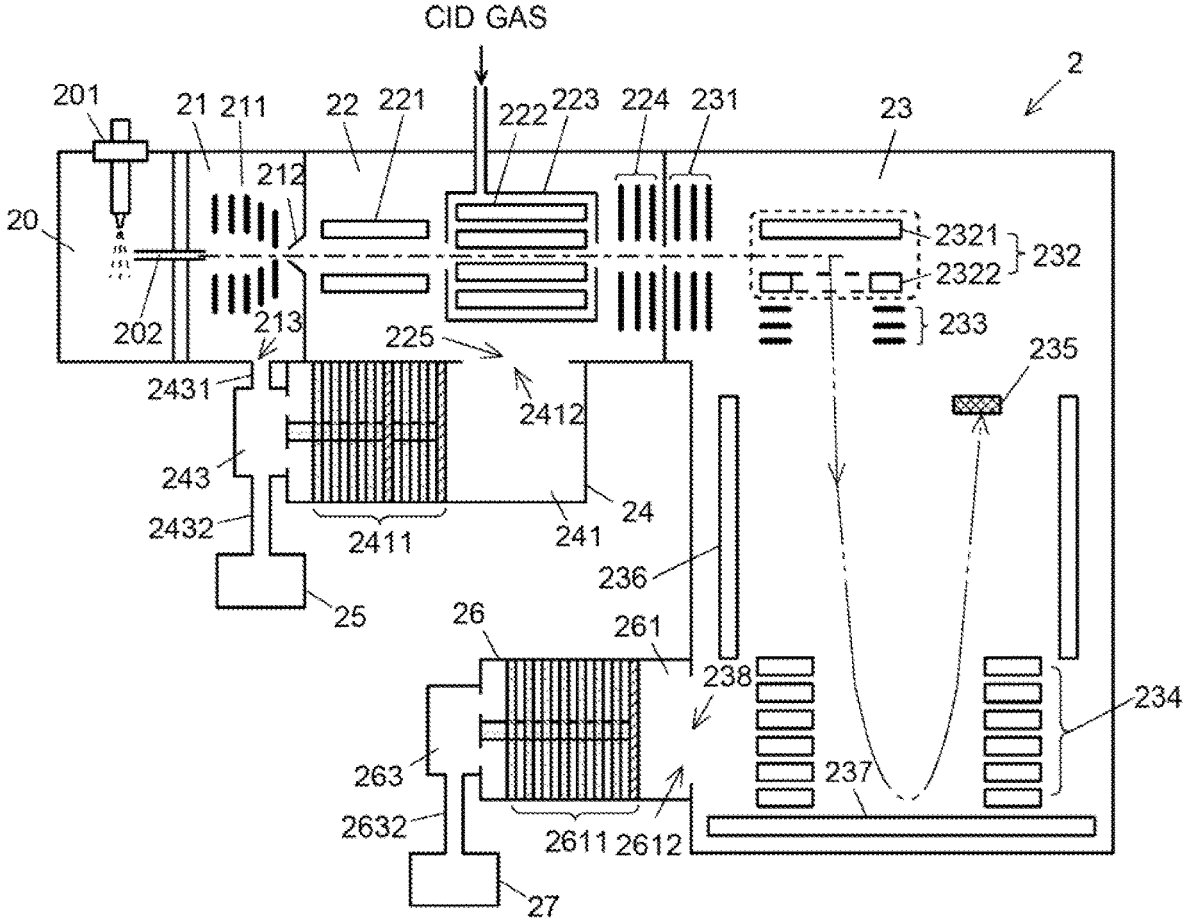
FIG. 2 is a block diagram showing main parts of quadrupole time-of-flight mass spectrometer corresponding to the second embodiment of the mass spectrometer according to the present invention.

A mass spectrometer 2 according to the second embodiment is a quadrupole time-of-flight mass spectrometer. FIG. 2 shows a block diagram of the main parts of the mass spectrometer 2 according to the second embodiment.

The mass spectrometer 2 according to the second embodiment also includes an ionization chamber 20, a first intermediate vacuum chamber 21, a second intermediate vacuum chamber 22, and an analysis chamber 23, as the mass spectrometer 1 according to the first embodiment. These chambers are provided in a vacuum chamber. The ionization chamber 20 is set at approximately atmospheric pressure. The mass spectrometer 2 has a multi-stage differential pumping system in which the degree of vacuum gradually increases in the order of the first intermediate vacuum chamber 21, the second intermediate vacuum chamber 22, and the analysis chamber 23.

The ionization chamber 20 includes an ESI probe 201. The ionization chamber 20 and the first intermediate vacuum chamber 21 communicate with each other through a heated capillary 202 having a small diameter.

The first intermediate vacuum chamber 21 includes an ion lens 211 composed of a plurality of annular-shaped electrodes. The first intermediate vacuum chamber 21 and the second intermediate vacuum chamber 22 are separated by a skimmer 212 having a small hole at its apex.

The second intermediate vacuum chamber 22 includes a quadrupole mass filter 221 that separates ions according to the mass-to-charge ratio, a collision cell 223 provided with, in its interior, a multi-pole ion guide 222, and an ion lens 224 that transports ions discharged from the collision cell 223 to the analysis chamber 23. The collision cell 223 is provided with a gas introduction port for introducing the CID gas, such as argon gas or nitrogen gas.

The analysis chamber 23 includes: an ion lens 231 for transporting ions incident from the second intermediate vacuum chamber 22; an orthogonal acceleration section 232 composed of two electrodes 2321 and 2322 opposite to each other across an optical axis of the incident ions (orthogonal acceleration region); a second acceleration section 233 that accelerates ions to be sent toward a flight space by the orthogonal acceleration section 232; a reflectron 234 that forms folded trajectories of ions in the flight space; an ion-detecting unit 235; and a flight tube 236 and a back plate 237 both positioned in the outer periphery of the flight space. The flight space of ions is defined by the reflectron 234, the flight tube 236, and the back plate 237.

The mass spectrometer 2 according to the second embodiment can perform an MS scanning measurement, MS/MS scanning measurement (product ion scanning measurement), and so on. In the mass spectrometer 2 according to the second embodiment, ions are introduced from the orthogonal acceleration section 232 to the flight space and mass separation is performed according to a time period taken by ions to fly in the flight space. This is the different point from the first embodiment.

The first intermediate vacuum chamber 21, the second intermediate vacuum chamber 22, and the analysis chamber 23 are provided in the vacuum chamber. The evacuation system is provided adjacent to the vacuum chamber. The first intermediate vacuum chamber 21 is provided with an opening 213 (corresponding to the first opening of the present invention). The second intermediate vacuum chamber 22 is provided with an opening 225 (corresponding to the second opening of the present invention). The analysis chamber 23 is provided with an opening 238.

The mass spectrometer 2 according to the second embodiment includes a first evacuation system and a second evacuation system. The first evacuation system includes a turbomolecular pump 24 and a rotary pump 25, and is used to exhaust the first intermediate vacuum chamber 21 and the second intermediate vacuum chamber 22. The second evacuation system includes a turbomolecular pump 26 and a rotary pump 27, and is used to exhaust the analysis chamber 23.

The turbomolecular pump 24 includes an operation chamber 241 and an exhaust chamber 243. The operation chamber 241 is provided with, in its interior, an intake port 2412 (corresponding to the first intake port of the present invention), and a blade rotor 2411 is placed between the intake port 2412 and the exhaust chamber 243. The exhaust chamber 243 is provided with an intake port 2431 (corresponding to the second intake port of the present invention) and an exhaust port 2432 that connects to the rotary pump 25.

The turbomolecular pump 26 includes an operation chamber 261 and an exhaust chamber 263. The operation chamber 261 is provided with, in its interior, an intake port 2612, and a blade rotor 2611 is placed between the intake port 2612 and the exhaust chamber 263. The exhaust chamber 263 is provided with an exhaust port 2632 connected to the rotary pump 27. For the turbomolecular pump 26, a pump having the exhaust flow rate greater than that of the turbomolecular pump 24 (a pump capable of evacuating a target space to a much higher degree of vacuum) is used.

The analysis chamber 23 communicates with the operation chamber 261 of the turbomolecular pump 26 through the opening 238 and the intake port 2612. The gas molecules taken from the analysis chamber 23 into the operation chamber 261 are displaced to the exhaust chamber 263 by the blade rotor 2611, and are discharged from the exhaust chamber 263 by the rotary pump 27.

The second intermediate vacuum chamber 22 communicates with the operation chamber 241 through the opening 225 and the intake port 2412. The first intermediate vacuum chamber 21 communicates with the exhaust chamber 243 through the opening 213 and the intake port 2431. The gas molecules taken from the second intermediate vacuum chamber 22 into the operation chamber 241 are displaced to the exhaust chamber 243 by the blade rotor 2411. The gas molecules displaced to the exhaust chamber 243 are discharged from the exhaust chamber 243 by the rotary pump 25 together with gas molecules taken from the first intermediate vacuum chamber 21.

In the mass spectrometer 2 according to the second embodiment, the first evacuation system and the second evacuation system constitute the differential pumping system, as described earlier. In the second embodiment, in view of the large capacity of the analysis chamber 23 having the flight space in its interior, the evacuation system is independently provided for evacuating the analysis chamber 23 to inhibit the increase in a time period required for evacuating the analysis chamber 23. Here, if there is no need to consider the time period required for the evacuation of the analysis chamber 23, or the capacity of the analysis chamber 23 is small, the analysis chamber 23 can be evacuated by only the first evacuation system. In such a case, in a similar manner as the turbomolecular pump 14 in the mass spectrometer 1 according to the first embodiment, the inside of the operation chamber may be divided into a first operation chamber and a second operation chamber, and a blade rotor may be provided for exhausting gas molecules in each of the operation chambers.

Each of the aforementioned embodiments is one of the examples of the present invention, and can be appropriately modified along purposes of the present invention. Although a rotary pump is provided as the roughing pump in the first and second embodiments, other types of vacuum pumps, such as a diaphragm pump, can be used. Furthermore, although one or two high vacuum chambers are evacuated by a single turbomolecular pump in the aforementioned embodiments, the operation chamber of the turbomolecular pump may be appropriately divided and the blade rotor may be placed between the divided operation chambers, to thereby constitute the differential pumping system in which three or more high vacuum chambers can be evacuated to the pressures different from one another. Alternatively, a plurality of intake ports may be provided in a single operation chamber, and the intake ports are respectively connected to the vacuum chambers in the vacuum chamber, so that a plurality of vacuum chambers can be evacuated to the equal degree of vacuum.

Although the first embodiment is embodied by the triple quadrupole mass spectrometer and the second embodiment is embodied by the time-of-flight mass spectrometer, a single quadrupole type mass spectrometer, an ion-trap mass spectrometer, and such various mass spectrometers provided with a plurality of vacuum spaces that constitute the differential pumping system can adopt a configuration similar to the previously-described configuration. Although each of the mass spectrometers according to the aforementioned embodiments is provided with the ESI probe for ionizing a liquid sample, the mass spectrometers may be provided with other atmospheric-pressure ion sources including an atmospheric pressure chemical ionization (APCI) prove. Alternatively, the mass spectrometers may be provided with an ion source that generates ions from a sample (including a solid sample and a gas sample) in vacuum atmosphere. In such a case, a predetermined modification may be added to the evacuation systems in the aforementioned embodiments. For example, a rotary pump may be connected to the ionization chamber.

[Aspects]

It is apparent for a person skilled in the art that a plurality of exemplary embodiments described earlier are specific examples of the following aspects of the present invention.

(First Aspect)

A mass spectrometer according to an aspect of the present invention includes:

a vacuum chamber divided into a low vacuum chamber and a high vacuum chamber, the low vacuum chamber having a wall provided with a first opening, and the high vacuum chamber having a wall provided with a second opening;

a turbomolecular pump having: an operation chamber that includes, in its interior, a blade rotor and is provided with a first intake port; and an exhaust chamber that communicates with the operation chamber and is provided with a second intake port and an exhaust port, the turbomolecular pump being placed so that the high vacuum chamber and the operation chamber communicate with each other through the second opening and the first intake port, and the low vacuum chamber and the exhaust chamber communicate with each other through the first opening and the second intake port; and a roughing pump connected to the exhaust port.

In the mass spectrometer according to the first aspect, the blade rotor provided in the operation chamber of the turbomolecular pump is operated to evacuate the high vacuum chamber in which a mass-separating unit and others are provided, through the second opening and the first intake port. Gas displaced from the operation chamber to the exhaust chamber is discharged by the roughing pump connected to the exhaust port of the exhaust chamber. The low vacuum chamber is evacuated by the roughing pump through the first opening and the second intake port. In the mass spectrometer according to the first aspect, the vacuum pump directly connected to the vacuum chamber is only the turbomolecular pump. Accordingly, structural components other than vacuum components can be easily provided around the vacuum chamber, in comparison with those in conventional mass spectrometers in which both the turbomolecular pump and the roughing pump are connected to the vacuum chamber. Furthermore, evacuation systems are put together in one side of the periphery of the vacuum chamber, to thereby miniaturize the entire apparatus.

(Second Aspect)

In the mass spectrometer according to the first aspect, the high vacuum chamber is divided into: a first high vacuum chamber provided with a third opening; and a second high vacuum chamber provided with the second opening, in ascending order of the distance from the low vacuum chamber, the turbomolecular pump has, in the interior of the operation chamber, a first blade rotor and a second blade rotor which are arranged in ascending order of distance from the exhaust chamber, where a first operation chamber placed between the first blade rotor and the second blade rotor and provided with a third intake port and a second operation chamber placed opposite to the first operation chamber across the second blade rotor and provided with the first intake port are provided in the operation chamber, and the first high vacuum chamber and the first operation chamber communicate with each other through the third opening and the third intake port, and the second high vacuum chamber and the second operation chamber communicate with each other through the second opening and the first intake port.

In the mass spectrometer according to the second aspect, three spaces including the first high vacuum chamber, the second high vacuum chamber, and the low vacuum chamber can be evacuated by only a single turbomolecular pump and a single roughing pump.

REFERENCE SIGNS LIST

1, 2 . . . Mass Spectrometer
10, 20 . . . Ionization Chamber
11, 21 . . . First Intermediate Vacuum Chamber (Low Vacuum Chamber)
113, 213 . . . Opening (First Opening)
12 . . . Second Intermediate Vacuum Chamber (First High Vacuum Chamber)
122 . . . Opening (Third Opening)
13 . . . Analysis chamber (Second High Vacuum Chamber)
136 . . . Opening (Second Opening)
14 . . . Turbomolecular Pump
141 . . . Operation Chamber (First Operation Chamber)
1411 . . . First Blade Rotor
1412 . . . Intake Port (First Intake Port)
142 . . . Operation Chamber (Second Operation Chamber)
1421 . . . Second Blade Rotor
1422 . . . Intake Port (Third Intake Port)
143 . . . Exhaust Chamber
1431 . . . Intake Port (Second Intake Port)
1432 . . . Exhaust Port
15 . . . Rotary Pump
22 . . . Second Intermediate Vacuum Chamber (High Vacuum Chamber)
225 . . . Opening
23 . . . Analysis Chamber
238 . . . Opening
24, 26 . . . Turbomolecular Pump
241, 261 . . . Operation Chamber
2411, 2611 . . . Blade Rotor
2412 . . . Intake Port (First Intake Port)
2612 . . . Intake Port
243, 263 . . . Exhaust Chamber
2431 . . . Intake Port (Second Intake Port)
2432, 2632 . . . Exhaust Port
25, 27 . . . Rotary Pump

The invention claimed is:

1. A mass spectrometer comprising:

a vacuum chamber divided into a low vacuum chamber and a high vacuum chamber, the low vacuum chamber having a wall provided with a first opening, and the high vacuum chamber having a wall provided with a second opening;

a turbomolecular pump having: an operation chamber that includes, in its inside, a blade rotor and is provided with a first intake port; and an exhaust chamber that communicates with the operation chamber and is provided with a second intake port and an exhaust port, the turbomolecular pump being placed so that the high vacuum chamber and the operation chamber communicate with each other through the second opening and the first intake port, and the low vacuum chamber and the exhaust chamber communicate with each other through the first opening and the second intake port; and a roughing pump connected to the exhaust port.

2. The mass spectrometer according to claim 1, wherein the high vacuum chamber is divided into: a first high vacuum chamber provided with a third opening; and a second high vacuum chamber provided with the second opening, in an order from the low vacuum chamber, the turbomolecular pump has, in an interior of the operation chamber, a first blade rotor and a second blade rotor which are arranged in an order from the exhaust chamber, where a first operation chamber placed between the first blade rotor and the second blade rotor and provided with a third intake port; and a second operation chamber placed opposite to the first operation chamber across the second blade rotor and provided with the first intake port are provided in the operation chamber, and the first high vacuum chamber and the first operation chamber communicate with each other through the third opening and the third intake port, and the second high vacuum chamber and the second operation chamber communicate with each other through the second opening and the first intake port.

3. The mass spectrometer according to claim 1, further comprising an ionization chamber connected to the vacuum chamber, wherein the low vacuum chamber is provided between the ionization chamber and the high vacuum chamber, and the low vacuum chamber is exhausted through the second intake port only.

* * * * *